US007569991B2

(12) United States Patent
Terao et al.

(10) Patent No.: US 7,569,991 B2
(45) Date of Patent: Aug. 4, 2009

(54) PLASMA DISPLAY PANEL AND MANUFACTURING METHOD OF THE SAME

(75) Inventors: Yoshitaka Terao, Yokohama (JP); Takashi Miyama, Yokohama (JP); Yukika Yamada, Yokohama (JP)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 471 days.

(21) Appl. No.: 11/343,267

(22) Filed: Jan. 31, 2006

(65) Prior Publication Data

US 2006/0181211 A1 Aug. 17, 2006

(30) Foreign Application Priority Data

Jan. 31, 2005 (JP) ..... 2005-024390
Nov. 9, 2005 (JP) ..... 2005-324988

(51) Int. Cl.
*H01J 17/49* (2006.01)

(52) U.S. Cl. ..... 313/582; 313/292; 313/584; 313/586; 445/24

(58) Field of Classification Search ..... 313/582–587, 313/238, 292, 609; 445/23–25
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,952,782 A 9/1999 Nanto
RE37,444 E 11/2001 Kanazawa (Continued)

FOREIGN PATENT DOCUMENTS

JP 2845183 10/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A- Description of Technology, Annex B—Relationship Between Voltage Terms And Discharge Characteristics; Annex C—Gaps and Annex D—Manufacturing.

*Primary Examiner*—Joseph L Williams
*Assistant Examiner*—Kevin Quarterman
(74) *Attorney, Agent, or Firm*—Robert E. Bushnell, Esq.

(57) ABSTRACT

A plasma display panel and manufacturing process therefor, providing an improved barrier rib strength in an opposing discharge structure. The plasma display panel may include a front substrate and a rear substrate, address electrodes extending in a predetermined direction on the rear substrate, and a barrier rib layer disposed between the front and rear substrates for defining a plurality of discharge spaces. The barrier rib layer includes barrier rib members for defining the plurality of discharge spaces, and display electrodes forming opposing electrodes with the discharge spaces therebetween, with grooves formed in a direction crossing the address electrodes on the barrier rib members facing the front substrate, and inner surfaces of the grooves that are coated with display electrodes.

19 Claims, 9 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 2003/0173899 | A1* | 9/2003 | Toyoda et al. | 313/583 |
| 2005/0052138 | A1* | 3/2005 | Kweon | 313/586 |
| 2005/0264201 | A1* | 12/2005 | Kang | 313/582 |
| 2006/0001375 | A1* | 1/2006 | Hur et al. | 313/582 |
| 2006/0076890 | A1* | 4/2006 | Hong et al. | 313/582 |
| 2006/0087237 | A1* | 4/2006 | Hur et al. | 313/582 |
| 2006/0113910 | A1* | 6/2006 | Kang et al. | 313/583 |
| 2006/0170352 | A1* | 8/2006 | Jung et al. | 313/582 |

FOREIGN PATENT DOCUMENTS

| | | |
|---|---|---|
| JP | 2917279 | 4/1999 |
| JP | 2001-043804 | 2/2001 |
| JP | 2001-325888 | 11/2001 |
| JP | 2004-273328 | 9/2004 |

* cited by examiner

PLASMA DISPLAY PANEL AND MANUFACTURING METHOD OF THE SAME

CLAIM OF PRIORITY

This application makes reference to, incorporates the same herein, and claims all benefits accruing under 35 U.S.C. § 119 from applications entitled PLASMA DISPLAY PANEL AND MANUFACTURING METHOD OF THE SAME, earlier filed in the Japanese Intellectual Property Office on 31 Jan. 2005 and 9 Nov. 2005, and there, duly assigned Serial Nos. 2005-024390 and 2005-324988, respectively.

BACKGROUND OF THE INVENTION

1. Field of the Invention

The present invention relates to a plasma display panel and a manufacturing method of the same and, more particularly, to a plasma display panel with improved barrier rib strength in an opposing discharge structure and a/manufacturing method of the same.

2. Related Art

A 3-electrode alternating current (AC) type of plasma display panel in the art is classified as a surface discharge type or an opposing discharge type. The surface discharge type of plasma display panel includes a front substrate and a rear substrate facing each other, and surface discharge occurs between a pair of electrodes arranged on the front substrate. In an opposing discharge type of plasma display panel, display electrodes are arranged on the front substrate and the rear substrate, respectively, and opposing discharge occurs between the display electrodes. In addition, Japanese patent laid-open publication No. 2004-273328 discloses an opposing discharge type of plasma display panel (hereinafter referred to as 'discharge between opposing electrodes') in which display electrodes are arranged between discharge spaces in each of discharge cells. The discharge structure between opposing electrodes has an advantage in that this structure can lower discharge firing voltage compared to a typical surface discharge structure.

However, high definition is required in recent plasma display panels. For this purpose, it is necessary to reduce the size of discharge cells (discharge spaces). However, when the size of the discharge cell is reduced, luminous efficiency is decreased, thereby lowering the brightness and display quality. Therefore, it is necessary to reduce an area that blocks the visible light while enhancing the aperture ratio. For example, in a plasma display panel with an opposing electrode structure, discharge surfaces are formed to be large in a thickness direction of the barrier ribs. In this case, however, laminations having a conductive layer become very thick. Therefore, there is a problem in that an occupied area in sheet members necessarily becomes large.

Furthermore, there is a problem in that mechanical strength of the conductive layer is very weak because the conductive layer is porous compared to a dielectric layer. In addition, since the barrier ribs need to be formed tenuously for high definition, the work efficiency is very low when the laminations are separated from a support member after a heating process. Accordingly, product yield is decreased, and it is difficult to reduce the product cost.

The above information disclosed in this background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a plasma display panel with improved barrier rib strength in an opposing discharge structure and a manufacturing method of the same.

An exemplary plasma display panel according to an embodiment of the present invention includes a front substrate and a rear substrate, and a barrier rib layer arranged between the front substrate and the rear substrate. Discharge spaces are formed in the barrier rib layer corresponding to each of discharge cells, and a discharge gas is filled into the discharge spaces and is sealed therein. Then, the radiation of light is generated by plasma discharge, thereby displaying an image. The barrier rib layer includes barrier rib members in a stripe pattern or in a matrix pattern, and the discharge cells are defined by the barrier ribs members. In addition, grooves are formed in a predetermined direction on the surface of the barrier rib members facing the front substrate. Furthermore, an inner surface of the grooves is coated with display electrodes, thereby forming opposing electrodes. Further, address electrodes in a stripe pattern are formed on the rear substrate while crossing the direction of the grooves, and the address discharge occurs between the display electrodes and the address electrodes.

Because the plasma display panel having the above construction has the grooves formed in a predetermined direction and the display electrodes coating the inner surface of the grooves, the aperture ratio can be enhanced. In other words, the ratio of the area occupied by the display electrodes on the front substrate can be controlled because the display electrodes according to the present exemplary embodiment are formed to face each other with the discharge space therebetween.

In addition, reinforcing material made of a dielectric substance is preferably formed in the grooves coated with the display electrodes. Therefore, the mechanical strength of the barrier rib layer can be improved, and the product yield can also be increased.

In the manufacturing method of the plasma display panel according to one preferred embodiment of the present invention, wherein the plasma display panel includes a barrier rib layer between the front and rear substrates, and discharge spaces for plasma discharge are formed in the barrier rib layer, is characterized in that the method includes forming a dielectric layer that is a base material of the barrier rib layer on the supporting member, forming grooves on the dielectric layer, applying a paste for electrodes to the grooves, and coating the inner surface of the grooves with display electrodes by drying the paste for the electrodes.

The grooves formed on the dielectric layer are formed in a stripe pattern or a matrix pattern and the inner surface of the grooves are coated with the display electrodes, thereby the shortening the manufacturing process and reducing the manufacturing cost. Consequently, the plasma display panel in which the ratio of the area occupied by the display electrodes on the front substrate can be reduced can be easily manufactured with a low cost.

Preferably, the manufacturing method may further include forming the barrier rib layer in a stripe pattern or a matrix pattern by patterning the dielectric layer after coating the inner surface of the grooves with the display electrodes. Furthermore, forming the grooves and patterning the dielectric layer may be simultaneously performed. Thereafter, the inner surface of the grooves with the display electrodes is coated to form the barrier rib layer, and then the forming of the grooves and the patterning of the dielectric layer may be sequentially performed. The display electrodes are then formed to provide the barrier rib layer.

In addition, the manufacturing method may further include forming the reinforcing material made of the dielectric substance by applying and drying the paste of the reinforcing material.

Thus, the mechanical strength of the barrier rib layer can be improved and the product yield of the plasma display panel can be increased.

According to another preferred embodiment of the present invention, the supporting member may be the front substrate. In other words, the barrier rib layer may be formed on the front substrate, and thereby the manufacturing process may be simplified.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

An embodiment of the present invention will hereinafter be described in detail with reference to the accompanying drawings. The present invention may, however, be embodied in different forms and should not be construed as limited to the exemplary embodiments set forth herein.

Figure 1:
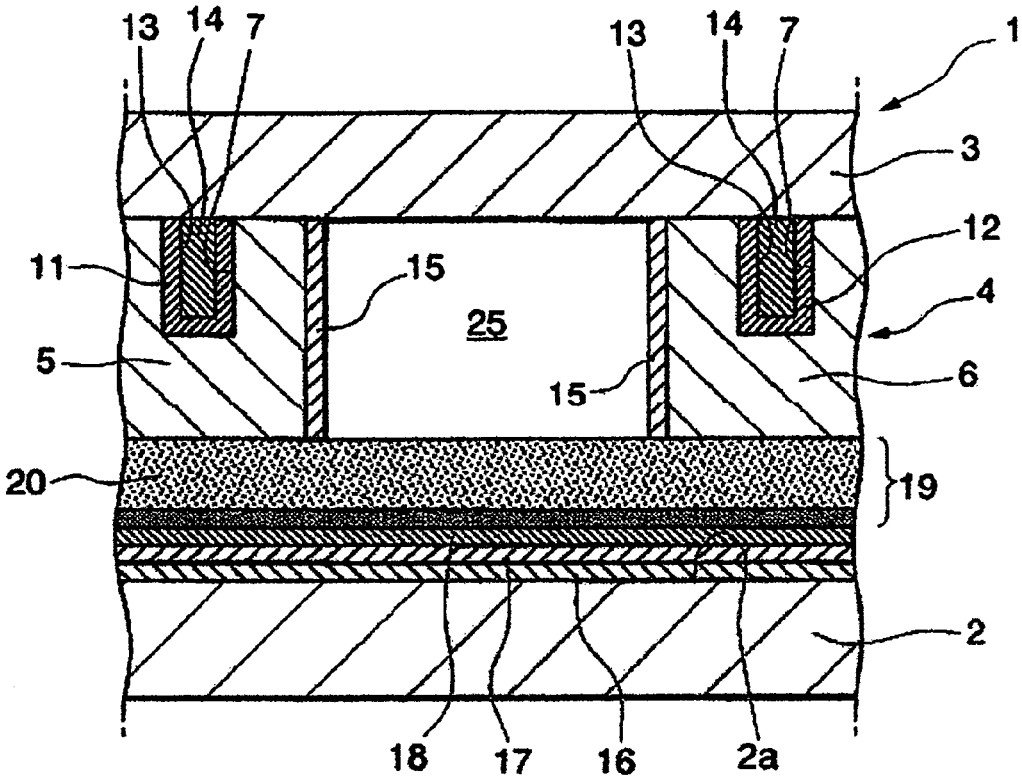
FIG. 1 is a cross-sectional view of the plasma display panel according to the first embodiment of the present invention.
Figure 2:
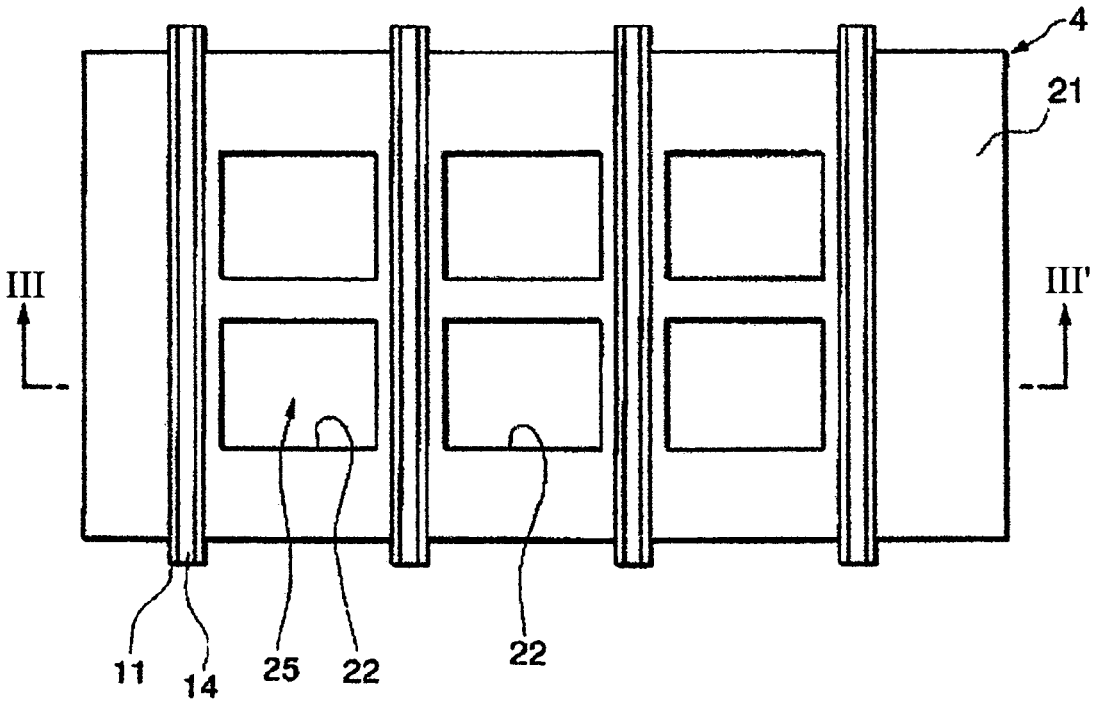
FIG. 2 is a plane view showing the barrier rib layer of the plasma display panel according to the first embodiment.
Figure 3:
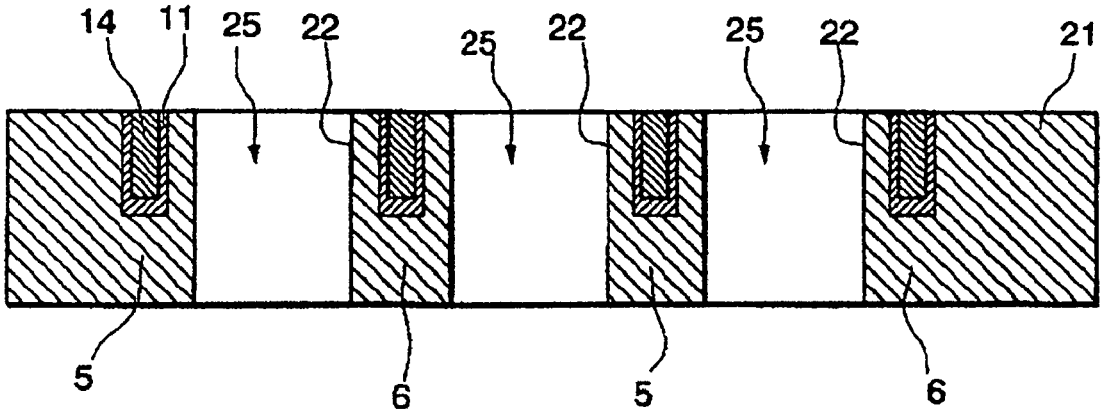
FIG. 3 is a cross-sectional view taken along the line III-III' of FIG. 2.
Figure 4:
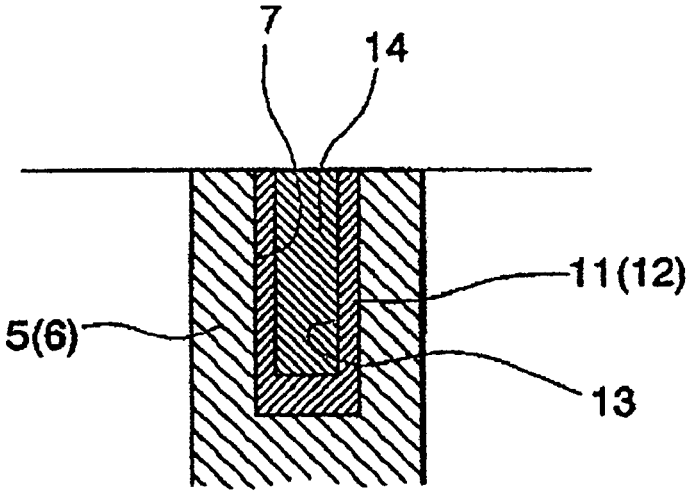
FIG. 4 is a cross-sectional view showing the barrier rib members of the barrier rib layer of the plasma display panel according to the first embodiment of the present invention.

FIG. 1 is a cross-sectional view of the plasma display panel according to the first embodiment of the present invention, FIG. 2 is a plane view showing the barrier rib layer of the plasma display panel according to the first embodiment, FIG. 3 is a cross-sectional view taken along the line A-A of FIG. 2, and FIG. 4 is a cross-sectional view showing the barrier rib members of the barrier rib layer of the plasma display panel according to the first embodiment of the present invention. The plasma display panel as shown in FIG. 1 through FIG. 4 is an exemplary embodiment, and the present invention is not limited thereto.

Referring to FIG. 1 through FIG. 4, the plasma display panel 1 according to the first embodiment includes a front substrate 3 and a rear substrate 2 facing each other. The front substrate 3 and the rear substrate 2 may be formed of a transparent material such as glass. A barrier rib layer 4 made of a dielectric substance is formed between the front substrate 3 and the rear substrate 2. Discharge spaces 25 are formed in the barrier rib layer 4 corresponding to each of discharge cells, and a discharge gas is filled into the discharge spaces 25. The radiation of light is generated by plasma discharge, thereby displaying an image on the front substrate 3. The barrier rib layer 4 includes barrier rib members 5 and 6, grooves 7 formed in the barrier rib members 5 and 6, and display electrodes 11 and 12 formed on the inner surface of the grooves 7. The barrier rib members 5 and 6 are formed in a matrix pattern, defining a plurality of discharge cells. The grooves 7 are formed to extend in a predetermined direction on each of the barrier rib members 5 and 6 facing the front substrate 3. The display electrodes 11 and 12 are formed on the inner surface of the grooves 7, and are arranged to face each other with the discharge spaces 25 therebetween. In the present embodiment, grooves 13 corresponding to the inner surface of the grooves 7 are formed on the display electrodes 11 and 12 facing the front substrate 3 because the display electrodes 11 and 12 are formed to cover the inner surface of the grooves 7. In other words, the display electrodes 11 and 12 do not completely fill up the grooves 7.

Reinforcing material 14 made of dielectric substances is filled into the grooves 13 of the display electrodes 11 and 12. The reinforcing material 14 is formed to completely fill the grooves 13 of the display electrodes 11 and 12. In addition, transparent protective layers 15 made of MgO are formed on surfaces of the barrier rib members 5 and 6 facing each other. Then, the front substrate 3 is disposed at the side of the reinforcing material 14 of the barrier rib layer 4, and the rear substrate 2 is disposed at the side opposite to the reinforcing material 14 of the barrier rib layer 4.

An undercoating layer 16 made of non-alkaline glass, etc., address electrodes 17 made of silver or a silver alloy in a stripe pattern (only one address electrode is shown in FIG. 1), and an overcoating layer 18 made of an inorganic filler such as titanium oxide, etc., are successively formed on an inner surface 2*a* of the rear substrate 2. Then, barrier ribs 19 in a stripe pattern are formed in parallel with each other on the overcoating layer 18. In addition, U-shaped phosphor layers 20 representing one of the red, green, and blue colors are formed on the surface of the overcoating layer 18 and on the sidewalls of the barrier ribs 19. The address electrodes 17 in a stripe pattern are formed on the rear substrate 2 in a direction crossing the grooves 7, and thereby plasma discharge occurs between the display electrodes 11 and 12 and the address electrodes 17.

As shown in FIG. 2 through FIG. 4, the barrier rib layer 4 is made of a dielectric layer 21. The dielectric layer 21 is made of a composite material of a glass frit and a resin such as ethyl cellulose, etc. The glass frit is made of a lead borosilicate group glass in which the content of the lead is relatively small. Furthermore, openings 22 in the shape of a square or rectangle are formed in the dielectric layer 21. The openings 22 are surrounded with the barrier rib members 5 and 6 to be arranged in a matrix pattern in the dielectric layer 21, and are formed to pass through in a thickness direction of the dielectric layer 21. Therefore, each of the discharge spaces 25 is surrounded with the front substrate 2, the rear substrate 3, and the barrier rib members 5 and 6.

In order to drive the PDP 1, a predetermined voltage is applied to the address electrodes 17 and one of the display electrodes 11 and 12. The address discharge occurs between the address electrodes 17 and the one of the display electrodes 11 and 12, and thereby wall charges are accumulated on the protective layer 15. Thereafter, a predetermined pulse voltage is applied between the display electrodes 11 and 12, and the sustain discharge occurs between them. The sustain discharge is maintained for a certain time by the wall charges, etc., accumulated on the protective layer 15. Ultraviolet (UV) rays generated by the sustain discharge excite the phosphor layer 20 within the discharge spaces 25, thereby causing visible light to be emitted. This visible light penetrates the front substrate 3, and this performs the display as one pixel.

Figure 5A:
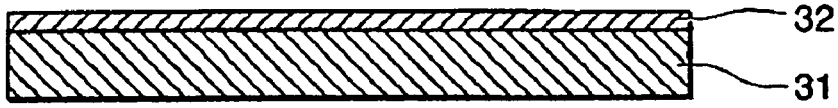
FIG. 5A through FIG. 5F are process views showing the manufacturing method of the plasma display panel according to the first embodiment of the present invention.

FIG. 5A through FIG. 7C are process views showing the manufacturing method of the plasma display panel according to the first preferred embodiment of the present invention. Referring to FIG. 5A, a peeling layer 32 of a 5 μm to 50 μm thickness is formed on a glass substrate 31 serving as the supporting member of the barrier rib layer 4. In the present embodiment, soda lime glass etc. can be used as the glass substrate 31.

The peeling layer 32 is formed of a glass frit that has a high melting point and that does not fuse within the temperature range of drying. For example, a glass frit having a high melting point is formed as a paste for the peeling layer, and the paste for the peeling layer includes a glass frit which has a high softening point and has an average particle diameter of 0.5 μm to 3 μm, ceramic particles such as alumina, zirconia, etc. which have an average particle diameter of 0.01 μm or 5 μm, resins such as ethyl cellulose, and solvents such as butyl carbitol acetate (BCA), etc. The paste for the peeling layer is printed on the glass substrates 31 by a thick film formation technique including a screen printing method. Thereafter, the paste for the peeling layer is heated to a predetermined temperature, for example, to approximately 150° C., for about 30 minutes in order to evaporate the solvents.

Figure 5B:
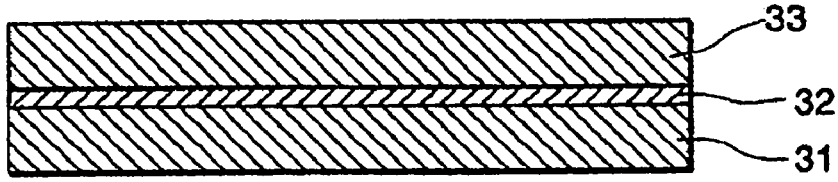
Figure 5C:
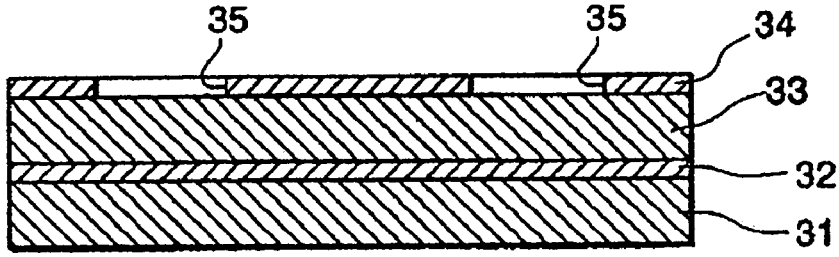

Subsequently, the dielectric layer 33, which is a base material of the barrier rib layer 4, is formed on the peeling layer 32 (referring to FIG. 5B). The dielectric layer 33 is formed using a paste, and the paste for the dielectric layer includes a glass frit that has an average particle diameter of 0.1 μm to 10 μm, a resin such as ethyl cellulose, and solvents such as butyl carbitol acetate (BCA), etc. Moreover, the glass frit may be made of a lead borosilicate group glass such as $PbO—B_2O_3—SiO_2—Al_2O_3—TiO_2$, etc. The composition ratio of the paste for the dielectric layer is the glass frit at 30 wt % to 90 wt %, the resin within a range of about 1 wt % to 5 wt %, and the solvent for the remainder.

The paste for the dielectric layer is applied to the peeling layer 32 using a coating device such as a die coater. The thickness of the paste for the dielectric layer is adjusted such that the dielectric layer has the desired thickness when the paste is fired. That is, when the thickness of the paste after coating it is 100%, it becomes 90% thereof after evaporation of the solvents in the drying process by contraction. In addition, the thickness of the paste measured after firing it becomes 90%*90%=81% by contraction. In this way, the thickness of the paste contracts by 100%−81%=19% from the thickness immediately after coating to the thickness after firing. Therefore, it is preferable that the thickness of the paste immediately after coating is approximately 250 μm (200 μm/0.81=246.9 μm) in order to attain a 200 μm thickness of the dielectric layer after firing.

Thereafter, the heating and drying processes are performed at a predetermined temperature at which the solvent within the paste evaporates, for example, at approximately 150° C., for about 30 minutes, thereby forming the dielectric layer 33. Then, a resist 34 for sandblasting is laminated on the dielectric layer 33 using a laminator (FIG. 5C), and it is exposed and developed to form a desired pattern thereon. Thus, openings 35 are formed in the resist 34 at locations corresponding to the grooves 7. The resist 34 may be, for example, ORDYL BF 704 (product of Tokyo Ohka Kogyo Co., Ltd.).

Figure 5D:
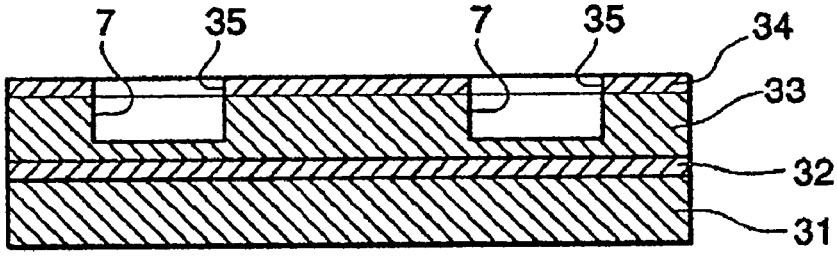
Figure 5E:
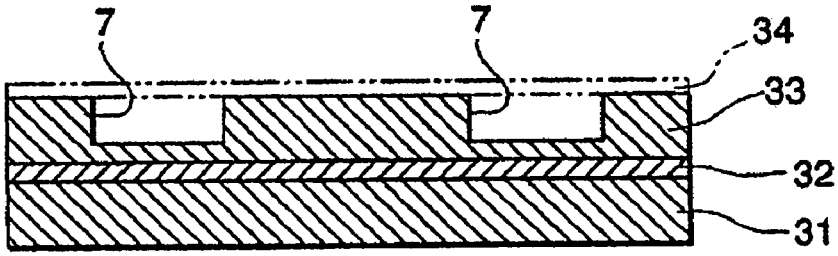

Subsequently, the exposed part of the dielectric layer 33 is selectively etched using a sandblasting machine to form the grooves 7 (FIG. 5D). It is preferable to use stainless steel balls (SUS #1500) as the abrasive for sandblasting. The depth of the grooves 7 can be adjusted to within +5 μm to −5 μm by controlling the blast time, the blast pressure, the amount of the abrasive etc. In the present embodiment, the depth of the grooves 7 is formed to be about half of the thickness of the dielectric layer 33, for example, approximately 100 μm.

Subsequently, the resist 34 is peeled off using a resist stripper (FIG. 5E), and the dielectric layer 33 is cleaned with the use of pure water and dried. As an example of the resist stripper, BF stripper B (product of Tokyo Ohka Kogyo Co., Ltd.) can be used.

Subsequently, the inner surfaces of the grooves 7 are coated such that display electrodes 11 and 12 having a cross-section in a U shape are formed. A paste for display electrodes is used in forming the display electrodes 11 and 12. For example, the paste includes Ag particles or Ag alloy particles having an average particle diameter of 0.05 μm to 5.0 μm and preferably 0.1 μm to 2.0 μm, a glass frit (inorganic binder) such as lead borosilicate glass, borosilicate bismuth glass, borosilicate zinc glass, etc. having an average particle diameter within a range between about 0.1 μm to 5.0 μm and preferably 0.1 μm to 2.0 μm, a resin such as ethyl cellulose, and a solvent such as butyl carbitol acetate (BCA) for viscosity.

Approximately, the composition ratio of the paste is Ag particles at 30 wt % to 80 wt %, the glass frit at 1 wt % to 20 wt %, the resin at 1 wt % to 10 wt %, and the solvent for the remainder. The volume of the applied paste contracts by about 10% to 30% when the solvent is evaporated due to drying, and the volume of the paste contracts by 70% to 95% from that after the drying process due to the firing process.

Figure 5F:
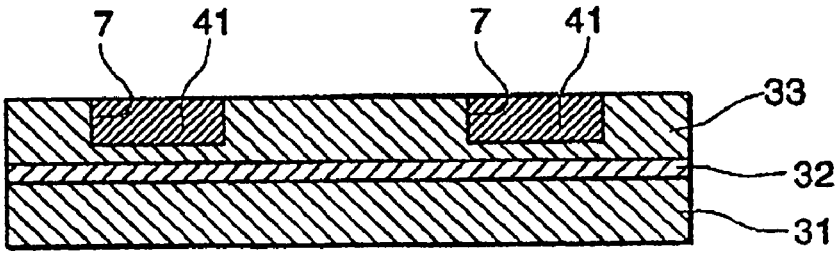
Figure 6A:
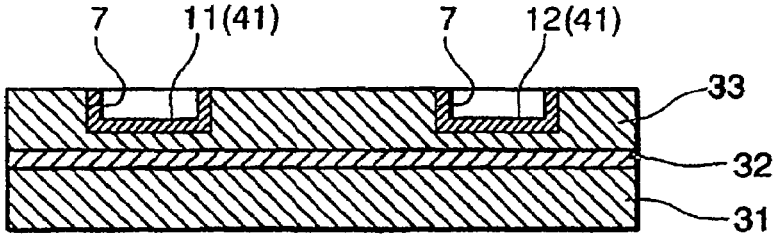
FIG. 6A through FIG. 6E are process views showing the manufacturing method of the plasma display panel according to the first embodiment of the present invention.

The paste 41 for the display electrodes is filled into the grooves 7 using a screen printing method, a dispensing method, or an ink jet method (FIG. 5F). Thereafter, the paste 41 is heated and dried at approximately 150° C. for about 30 minutes using an electrical furnace or an oven with a constant temperature. Accordingly, the volume of the paste 41 for display electrodes contracts, and the display electrodes 11 and 12 having a cross-section in a U shape are formed on the inner surface of the grooves 7 (FIG. 6A).

Figure 6B:
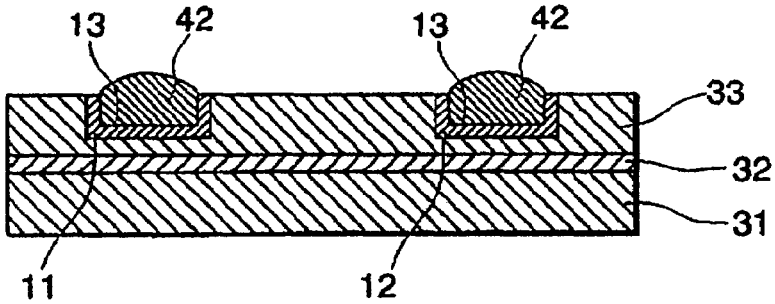

Subsequently, a paste 42 for forming a reinforcing material is deposited on grooves 13 formed in the display electrodes 11 and 12 (FIG. 6B). The aforementioned paste for the dielectric layer may be used. Alternatively, a different paste for a dielectric layer in which the strength is improved considering compactness, viscosity, elasticity, etc. may be utilized. As other alternatives, a paste for a dielectric layer that has inorganic particles such as metal oxides as a main component, or a conductive paste that has metal particles as a main component, may be used.

The paste 42 for forming the reinforcing material is filled into the grooves 13 using a screen printing method, a dispensing method, or an ink jet method. In this case, it is preferable that the surface of the paste 42 for forming the reinforcing material is higher than the surface of the dielectric layer 33 and the opening of the grooves 13 when it is deposited, so that the surface thereof is on the same plane as the surface of the dielectric layer 33 and the opening of the grooves 13 when the paste 42 is dried and the solvent is evaporated.

Figure 6C:
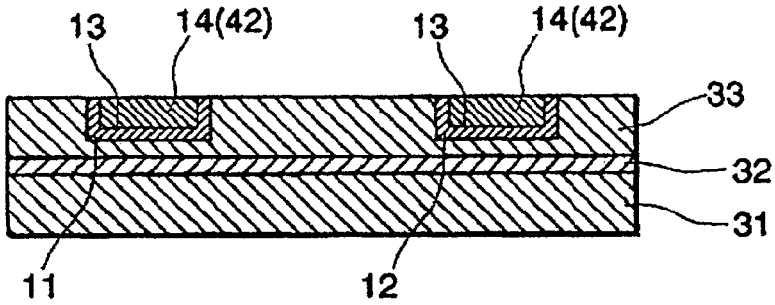

The paste 42 for forming the reinforcing material is heated and dried at a temperature of approximately 150° C. for about 30 minutes using an electrical furnace or an oven with a constant temperature. Accordingly, the volume of the paste 42 contracts, and the reinforcing material 14 which is on the same plane as the dielectric layer 33 and the opening of the grooves 13 is formed (FIG. 6C).

Figure 6D:
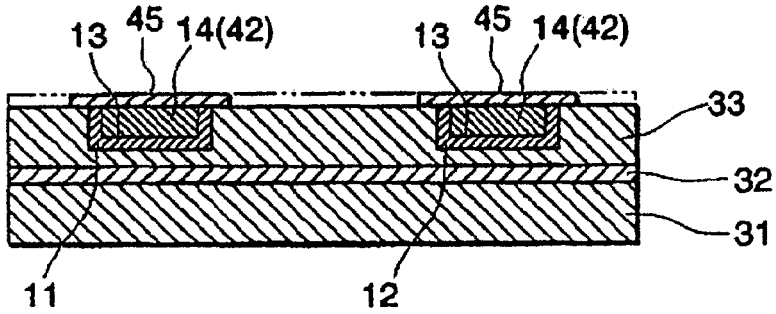

Subsequently, a resist 45 for sandblasting is laminated on the dielectric layer 33 and the reinforcing material 14 using a laminator (FIG. 6D). Then, the resist 45 is exposed and developed with a desired pattern, so that the resist 45 remains only at locations corresponding to the barrier rib members 5 and 6. As an example of the resist for sandblasting, ORDYL BF 704 (product of Tokyo Ohka Kogyo Co., Ltd.) may be used.

Figure 6E:
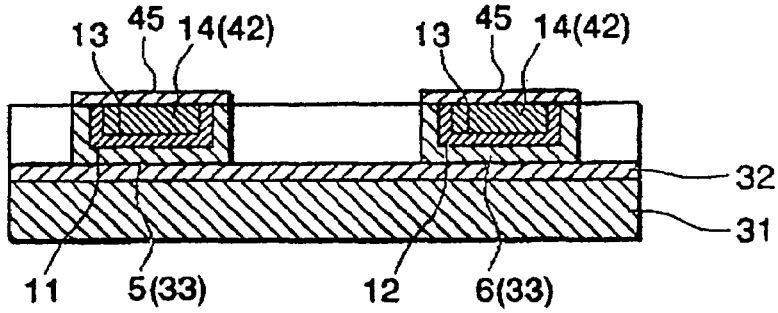

The exposed part of the dielectric layer 33 is then selectively etched using a sandblasting machine to form the barrier rib members 5 and 6 (FIG. 6E). It is preferable that stainless steel balls (SUS #1500) are used as the abrasive for sandblasting. In this case, the dielectric layer 33 is etched until the peeling layer 32 is exposed, thereby forming discharge spaces 25.

Figure 7A:
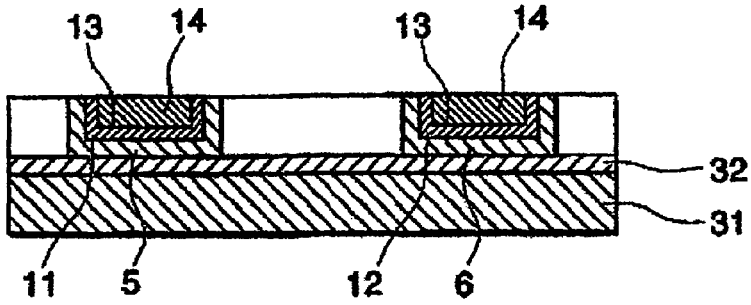
FIG. 7A through FIG. 7C are process views showing the manufacturing method of the plasma display panel according to the first embodiment of the present invention.

The resist 45 for sandblasting is peeled off using the resist stripper (FIG. 7A). Thereafter, the barrier rib members 5 and 6, the display electrodes 11 and 12, and the reinforcing material 14 are cleaned with pure water and dried. The resist stripper may be, for example, BF stripper B (product of Tokyo Ohka Kogyo Co., Ltd.).

Figure 7B:
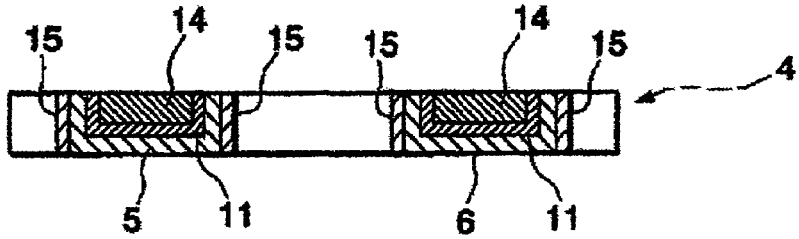
Figure 7C:
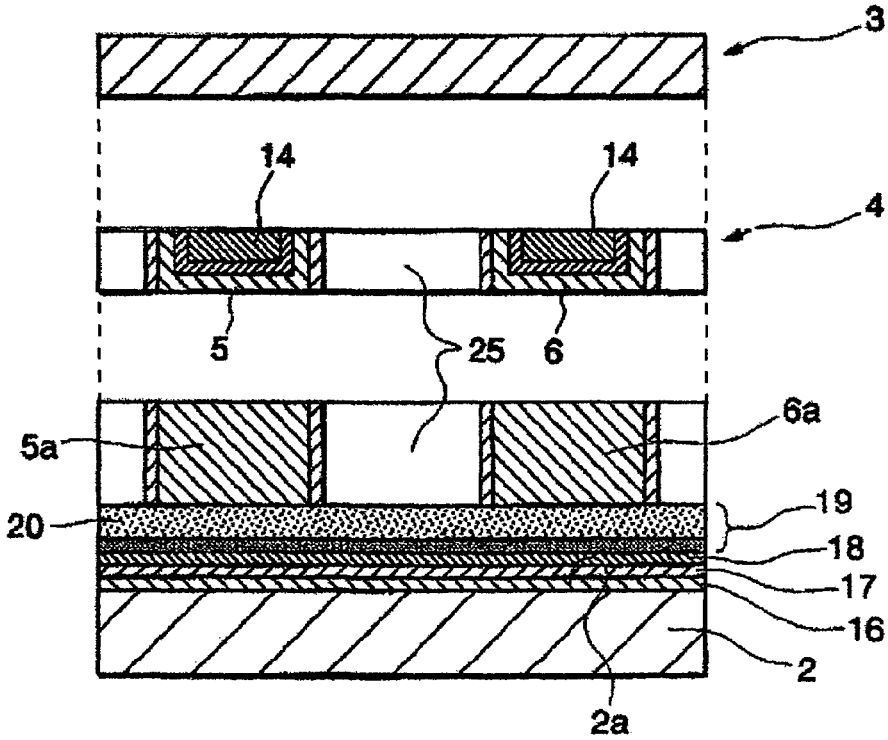

Next, the firing process is performed in a temperature range where the barrier rib members 5 and 6, the display electrodes 11 and 12, and the reinforcing material 14 sinter and the high melting point glass frit of the peeling layer 32 does not frit, for example in a temperature range of approximately 550° C. to 600° C. (FIG. 7B). Then, a MgO layer with a 7000 Å thickness is deposited using evaporation coating, thereby forming a transparent protective layer 15. Therefore, the barrier rib layer 4 that is detachable from the glass substrate 31 is produced.

Subsequently, the undercoat layer 16 through the phosphor layer 20 and lower barrier rib members 5*a* and 6*a* are formed on the inner surface 2*a* of the rear substrate 2 (FIG. 7C), and the barrier rib layer 4, the front substrate 3, and the rear substrate 2 are aligned and attached to each other. The periphery of the attached PDP 1 is then sealed with a sealing material such as glass frit, and a discharge gas such as Xe gas is injected into the discharge spaces 25. The PDP 1 according to the present embodiment is thus manufactured.

The PDP 1 according to the present embodiment includes the barrier rib layer 4, the barrier rib members 5 and 6 defining the discharge spaces 25 in a matrix pattern, the grooves 7 formed in a predetermined direction on the barrier rib members 5 and 6 facing the front substrate 3, and the display electrodes 11 and 12 coating the inner surface of the grooves 7 and forming an opposing electrodes therebetween. By this configuration, the ratio of the area occupied by the display electrodes on the front and rear substrates 2 and 3 can be controlled. In addition, because the reinforcing material 14 is formed in the grooves 13 of the display electrodes 11 and 12, the mechanical strength of the barrier rib layer can be improved and the product yield can be increased.

According to the manufacturing method of the PDP 1 of the present embodiment, the ratio of the area occupied by the display electrodes 11 and 12 on the front and rear substrates 2 and 3 can be controlled and the discharge surface area can be increased. Therefore, the brightness can be significantly increased. In addition, the PDP in which the mechanical strength of the barrier rib members 5 and 6 and the product yield are increased can be easily manufactured with low cost.

Figure 8A:
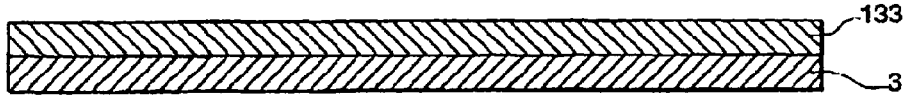
FIG. 8A through FIG. 8G are process views showing the manufacturing method of the plasma display panel according to the second embodiment of the present invention.
Figure 8B:
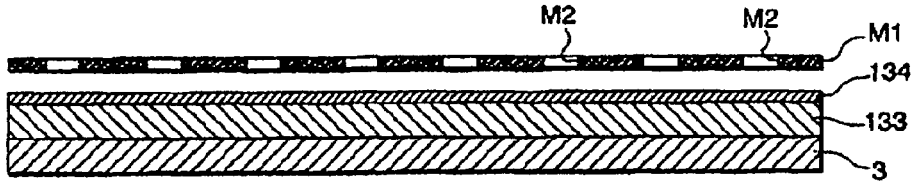

FIG. 8A through FIG. 9F are process views showing the manufacturing method of the plasma display panel according to the second embodiment of the present invention. Referring to FIG. 8A, a dielectric layer 133, which is a base material of a barrier rib layer, is formed on a front substrate 3 using a paste. In addition, as in the first embodiment, the paste for the dielectric layer may include a glass frit that has an average particle diameter within a range between approximately 0.1 μm to 10 μm, a resin such as ethyl cellulose, and solvents such as butyl carbitol acetate (BCA), etc. Moreover, the glass frit may be made of a lead borosilicate group glass such as PbO—$B_2O_3$—$SiO_2$—$Al_2O_3$—$TiO_2$, etc. Further, the composition ratio of the paste for the dielectric layer is the glass frit at 30 wt % to 90 wt %, the resin at between 1 wt % to 5 wt %, and the solvent making up the remainder.

The paste for the dielectric layer is applied to the front substrate 3 using a coating device such as a die coater. Like in the first embodiment, the thickness of the paste for the dielectric layer is adjusted such that a dielectric layer with a desired thickness can be formed when the paste is fired. Thereafter, the heating and drying processes are performed at a temperature at which the solvent within the paste evaporates, for example at 150° C., for 30 minutes, thereby forming the dielectric layer 133.

Figure 8C:
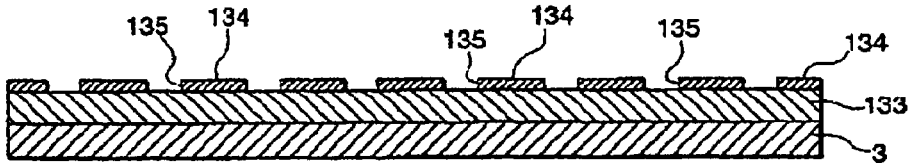

Subsequently, a resist 134 for sandblasting is laminated on the dielectric layer 133 using a laminator (FIG. 8B), and a mask layer M1 for patterning the resist 134 is arranged thereover. In this mask layer M1, openings M2 corresponding to the grooves for display electrodes are formed in a predetermined pattern, for example, in a stripe or matrix pattern. Then, the resist 134 is exposed and developed to form openings 135 at locations corresponding to the openings M2 of the mask layer M1 (FIG. 8C). The resist 134 for sandblasting may be, for example, ORDYL BF 704 (product of Tokyo Ohka Kogyo Co., Ltd.).

Figure 8D:
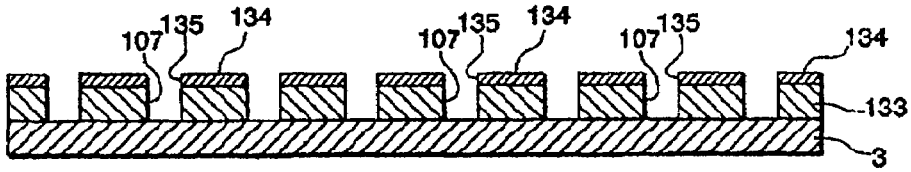
Figure 8E:
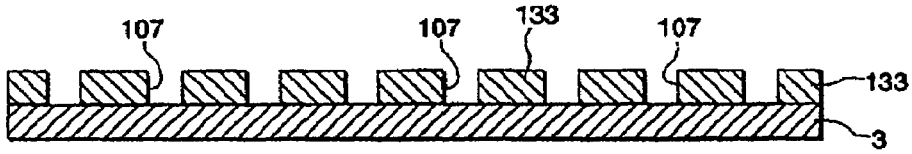

The part of the dielectric layer 133 exposed through the openings 135 is selectively etched using a sandblasting machine to form grooves 107 (FIG. 8D). As in the first embodiment, it is preferable that stainless steel balls (SUS #1500) are used as the abrasive for sandblasting. The depth of the grooves 107 can be adjusted to within +5 μm to −5 μm by controlling the blast time, the blast pressure, the amount of the abrasive, etc. In the present embodiment, the depth of the grooves 107 is about the thickness of the dielectric layer 133 such that a part of the front substrate 3 is exposed.

The resist 134 is then peeled off using the resist stripper for sandblasting (FIG. 8E), and the dielectric layer 133 is cleaned with pure water and dried. The resist stripper may be, for example, BF stripper B (product of Tokyo Ohka Kogyo Co., Ltd.).

Subsequently, the inner surface of the grooves 107 is coated such that display electrodes 111 and 112 having a cross-section in a U shape are formed. As in the first embodiment, a paste is used for forming the display electrodes 111 and 112. As an example, the paste may include Ag particles or Ag alloy particles having an average particle diameter of between approximately 0.05 μm to 5.0 μm and preferably 0.1 μm to 2.0 μm, a glass frit (inorganic binder) such as lead borosilicate glass, borosilicate bismuth glass, borosilicate zinc glass, etc. having an average particle diameter of 0.1 μm to 5.0 μm and preferably 0.1 μm to 2.0 μm, a resin such as ethyl cellulose, and a solvent such as butyl carbitol acetate (BCA) for viscosity. Approximately, the composition ratio of the paste is Ag particles at 30 wt % to 80 wt %, the glass frit at 1 wt % to 20 wt %, the resin at 1 wt % to 10 wt %, and the solvent makes up the remainder. The volume of the applied paste contracts about by between 10% to 30% when the solvent is evaporated due to drying. In addition, the volume of the paste contracts by 70% to 95% from the drying process to the firing process.

Figure 8F:
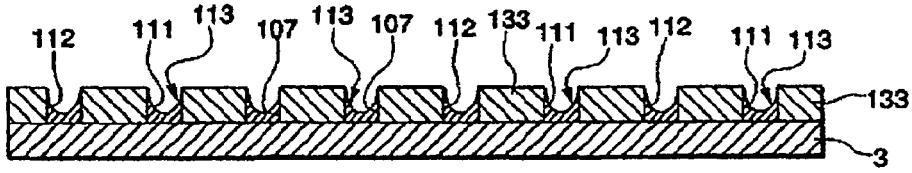

Next, the paste for display electrodes is filled into the grooves 107 using a screen printing method, a dispensing method, or an ink jet method, and the paste is heated up and dried at approximately 150° C. for about 30 minutes using an electrical furnace or an oven with a constant temperature. Accordingly, the volume of the paste contracts, and the display electrodes 111 and 112 having a cross-section in a U shape are formed on the inner surface of the grooves 107 (FIG. 8F). The grooves 107 are not completely filled with the display electrodes 111 and 112 because the volume of the paste for display electrodes contracts. Accordingly, further grooves 113 are formed in the display electrodes 111 and 112.

Figure 8G:
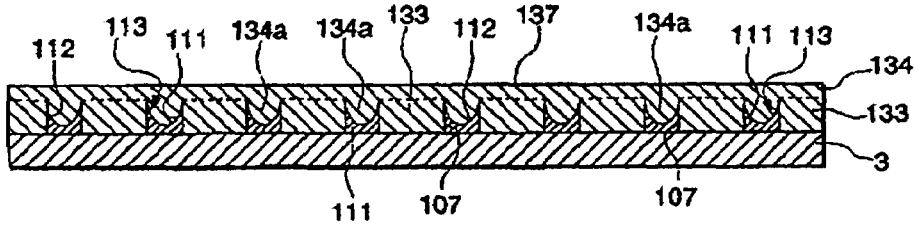

Subsequently, another dielectric layer 137 is deposited on the dielectric layer 133 and in grooves 113 formed in the display electrodes 111 and 112 (FIG. 8G). The dielectric layer 137 is formed using a paste, and the aforementioned paste for a dielectric layer may be used. Furthermore, a different paste for the dielectric layer in which the strength is improved considering compactness, viscosity, elasticity, etc. may be used, instead of the aforementioned paste for a dielectric layer. As further alternatives, a paste for a dielectric layer that has inorganic particles such as metal oxides as main components, or a conductive paste that has metal particles as main components, may be used.

In the present embodiment, the paste is filled into the grooves 113 using a screen printing method, a dispensing method, or an inkjet method until the dielectric layer 133 is fully covered with the paste. Thereafter, the paste for display electrodes is heated and dried at 150° C. for 30 minutes using an electrical furnace or an oven with a constant temperature. Then, the paste is dried, thereby forming another dielectric layer 137 (FIG. 8G). The dielectric layer 137 is filled into the grooves 113 while being laminated on the dielectric layer 133. The dielectric layer 137 filled into the grooves 113 serves as a reinforcing material 134*a* of the display electrodes 111 and 112, and it is formed of the dielectric paste used for forming the dielectric layer 133. Therefore, the dielectric layer 133 is integrated with the dielectric layer 137, thereby increasing the strength of the barrier rib layer. In addition, the strength of the barrier rib layer is further increased because the dielectric layer 137 filled into the grooves 113 serves as the reinforcing material 134*a*.

Figure 9A:
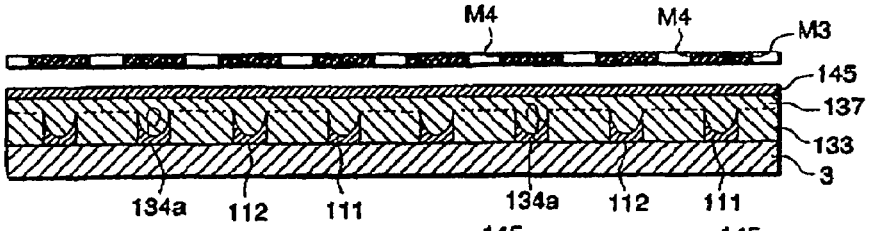
FIG. 9A through FIG. 9F are process views showing the manufacturing method of the plasma display panel according to the second embodiment of the present invention.
Figure 9B:
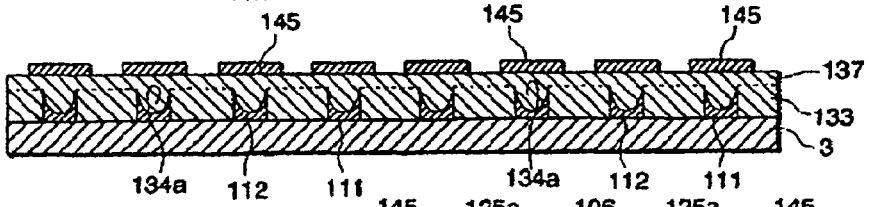
Figure 9C:
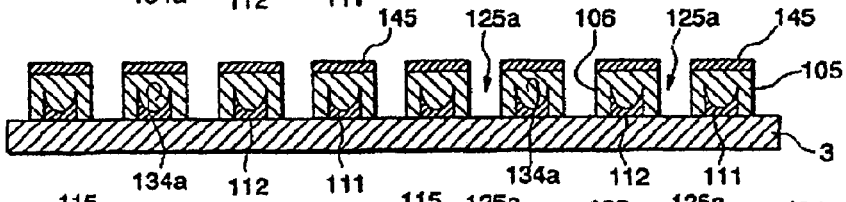

A resist 145 for sandblasting is laminated on the dielectric layer 137 using a laminator. In addition, a mask layer M3 is arranged over the resist 145 (FIG. 9A). In this mask layer M3, openings M4 corresponding to the discharge spaces are formed in a predetermined pattern, for example, in a stripe or matrix pattern. Then, the resist 145 is exposed and developed such that the resist 145 remains at locations corresponding to the openings M4 of the mask layer M3, i.e., at locations corresponding to barrier rib members 105 and 106 (FIG. 9B). The resist 145 for sandblasting may be, for example, ORDYL BF 704 (product of Tokyo Ohka Kogyo Co., Ltd.).

Next, the part of the dielectric layer 137 exposed by the patterned resist 145 is selectively etched using a sandblasting machine to form the barrier rib members 105 and 106 (FIG. 9C), and the dielectric layer 133 is etched until the front substrate 3 is exposed. The barrier rib members 105 and 106 are formed of an integrated dielectric layer including the dielectric layer 133 and the dielectric layer 137. In this way, the dielectric layer 133 and the dielectric layer 137 are etched until the front substrate 3 is exposed, thereby forming a part of discharge spaces 125. In other words, a dielectric substance of the barrier rib members 105 and 106 is disposed between the discharge space 125*a* and the display electrodes 111 and 112. It is preferable that stainless steel balls (SUS #1500) are used as the abrasive for sandblasting.

The resist 145 for sandblasting is then peeled off using the resist stripper (FIG. 9D), and the dielectric layer 133 is cleaned with pure water and dried. The resist stripper may be, for example, BF stripper B (product of Tokyo Ohka Kogyo Co., Ltd.). Subsequently, the firing process is performed in a temperature range where the barrier rib members 105 and 106, the display electrodes 111 and 112, and the reinforcing material 134*a* sinter, for example in a temperature range of approximately 550° C. to 600° C.

Figure 9D:
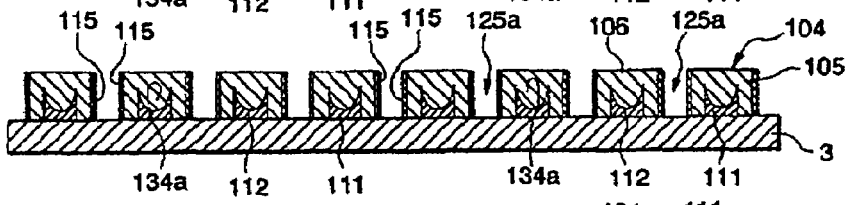

Then, a MgO layer with a 7000 Å thickness is deposited on the sidewall of the barrier rib members 105 and 106 using evaporation coating, thereby forming a transparent protective layer 115 (FIG. 9D). The barrier rib layer 104 is thus formed on the front substrate 3.

Figure 9E:
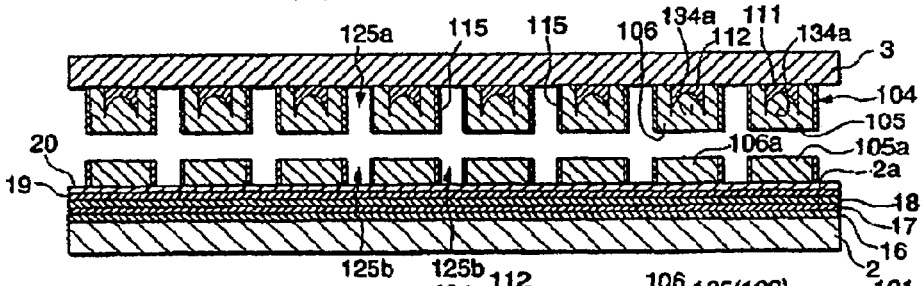

Subsequently, the undercoat layer 16 through the phosphor layer 20 and the lower barrier rib members 105*a* and 106*a* are formed on the inner surface 2*a* of the rear substrate 2 (FIG. 9E). Then, the barrier rib layer 104, the front substrate 3, and the rear substrate 2 are aligned and attached to each other such that the discharge spaces 125*a* formed on the front substrate 3 and the discharge spaces 125*b* formed on the rear substrate 2 are integrated. Thereafter, the periphery of the attached PDP 101 is sealed up with a sealing material such as glass frit, and a discharge gas such as Xe gas is injected into the integrated discharge spaces 125. Therefore, the PDP 101 according to the present embodiment is manufactured.

Figure 9F:
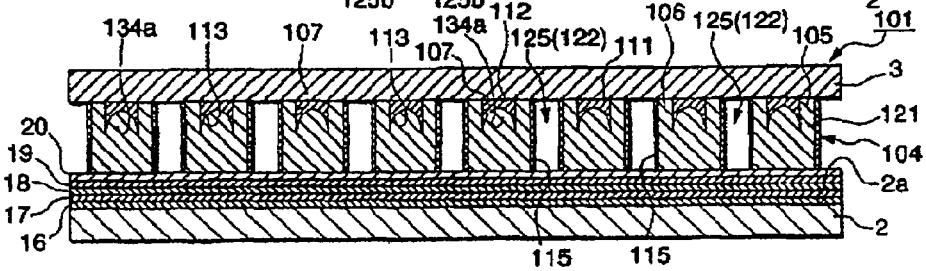

FIG. 9F is the cross-sectional view showing the PDP 101 manufactured according to the present embodiment. Referring to FIG. 9F, the PDP 101 is configured to have the rear substrate 2 and the front substrate 3, and the barrier rib layer 104 is arranged between the rear substrate 2 and the front substrate 3 and is made of a dielectric substance. The discharge spaces 125 are formed in the barrier rib layer 104 corresponding to each of discharge cells, and a discharge gas is filled into the discharge spaces 125. Then, the radiation of light is generated by plasma discharge, thereby displaying an image on the front substrate 3.

The barrier rib layer 104 includes the barrier rib members 105 and 106 with the grooves 107 formed therein, and the display electrodes 111 and 112 formed on the inner surface of the grooves 107. The barrier rib members 105 and 106 are formed in a matrix pattern, defining a plurality of discharge cells. The grooves 107 are formed to extend in a predetermined direction on each of the barrier rib members 105 and 106 facing the front substrate 3. The display electrodes 111 and 112 are formed on the inner surface of the grooves 107, and are arranged to face each other with the discharge spaces 125 therebetween. In the present embodiment, grooves 113 corresponding to the inner surface of the grooves 107 are formed on the display electrodes 111 and 112 facing the rear substrate 2 because the display electrodes 111 and 112 are formed to cover the inner surface of the grooves 107.

The reinforcing material 134*a* made of a dielectric substance is filled into the grooves 113 of the display electrodes 111 and 112. The reinforcing material 134*a* is made of the dielectric substance forming the barrier rib members 105 and 106, and are formed to completely fill up the grooves 113 of the display electrodes 111 and 112. In addition, the transparent protective layers 15 made of MgO are formed on surfaces of the barrier rib members 105, 106 facing each other, respectively. Then, the front substrate 3 is disposed at the side of the display electrodes 111 and 112 of the barrier rib layer 104, and the rear substrate 2 is disposed at the opposite side to the display electrodes 111 and 112 of the barrier rib layer 104.

As in the first embodiment, the undercoating layer 16, the address electrodes 17, and the overcoating layer 18 are successively formed on the inner surface 2*a* of the rear substrate 2. Then, the barrier ribs 19 in a stripe pattern are formed in parallel with each other on the overcoating layer 18. In addition, the U-shaped phosphor layers 20 representing one of the red, green, and blue colors are formed on the surface of the overcoating layer 18 and on the sidewall of the barrier ribs 19. The address electrodes 17 in a stripe pattern are formed on the rear substrate 2 in a direction crossing the grooves 107, and thereby plasma discharge occurs between the display electrodes 111 and 112 and address electrodes 17.

As in the first embodiment, the barrier rib layer 104 is made of the dielectric layer 121. The dielectric layer 121 is made of a composite material of a glass frit and a resin. Openings 122 in the shape of a square or a rectangle, i.e., the discharge spaces, are formed in the dielectric layer 121. The openings 122 are surrounded with the barrier rib members 105 and 106 to be arranged in a matrix pattern in the dielectric layer 121, and are formed to pass through in a thickness direction of the dielectric layer 121. Therefore, each of the discharge spaces 125 is surrounded with the front substrate 2, the rear substrate 3, and the barrier rib members 105 and 106.

As in the first embodiment, in order to drive the PDP 101, a predetermined voltage is applied to the address electrodes 17 and one of the display electrodes 111 and 112. The address discharge occurs between the address electrodes 17 and the one of the display electrodes 111 and 112, and thereby wall charges are accumulated on the protective layer 115. Thereafter, a predetermined pulse voltage is applied between the display electrodes 111 and 112, so the sustain discharge occurs therebetween. The sustain discharge is maintained for a certain time by the wall charges, etc., accumulated on the protective layer 115. Ultraviolet (UV) rays generated by the sustain discharge excite the phosphor layer 20 within the discharge spaces 125, thereby causing it to emit the visible light. This visible light penetrates the front substrate 3, and this performs the display as one pixel.

According to the manufacturing method of the PDP 101 of the present embodiment, the barrier rib layer 104 is directly formed on the front substrate 3. Therefore, the process of peeling off the barrier rib layer from the supporting member can be omitted, and the manufacturing processes can be simplified. In addition, according to the PDP 101 of the present embodiment, similar effects of the first embodiment can be obtained.

FIG. 10 and FIG. 11 are process views showing the manufacturing method of a PDP 201 according to the third embodiment of the present invention.

Figure 10A:
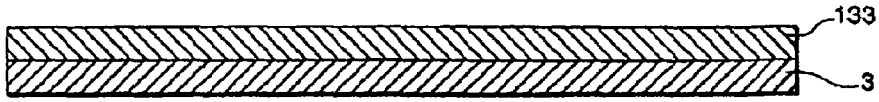
FIG. 10A through FIG. 10G are process views showing the manufacturing method of the plasma display panel according to the third embodiment of the present invention.
Figure 10B:
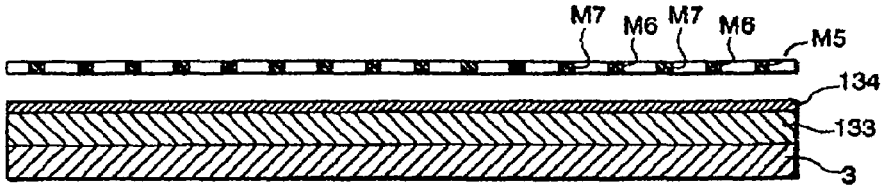

Firstly, a dielectric layer 133, which is a base material of a barrier rib layer 204, is formed on a front substrate 3 (FIG. 10A). The dielectric layer 133 is formed in the same way as in the first and second embodiments.

Subsequently, a resist 134 for sandblasting is laminated on the dielectric layer 133 using a laminator (FIG. 10B), and a mask layer M5 for patterning the resist 134 is arranged over the resist 134. In this mask layer M5, first openings M6 corresponding to the display electrodes and second openings M7 corresponding to the discharge spaces are formed. The first openings M6 may be formed in a predetermined pattern, for example, in a stripe or a matrix pattern. In addition, the second openings M7 may be formed in a predetermined pattern, for example, in a stripe or a matrix pattern.

Figure 10C:
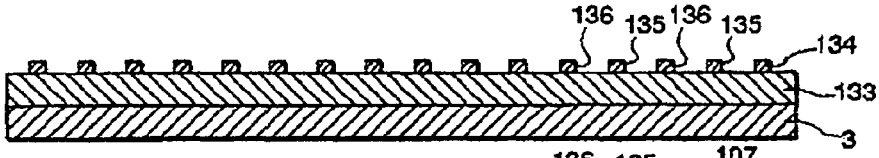

The resist 134 for sandblasting is then exposed and developed, forming openings 135 corresponding to the first openings M6 of the mask layer M5 and openings 136 corresponding to the second openings M7 of the mask layer M5 in the resist 134 at the same time (FIG. 10C).

Figure 10D:
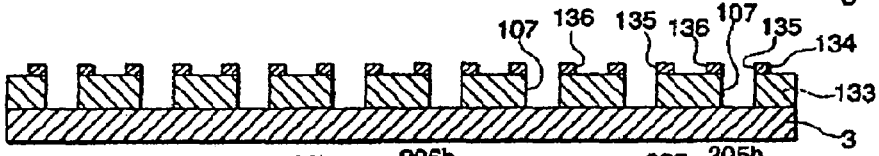

Subsequently, the part of the dielectric layer 133 exposed through the openings 135 is selectively etched using a sandblasting machine to form grooves 107 (FIG. 10D). As in the first embodiment, it is preferable that stainless steel balls (SUS #1500) are used as the abrasive during sandblasting. The depth of the grooves 107 can be adjusted to within +5 μm to −5 μm by controlling the blast time, the blast pressure, the amount of the abrasive, etc. In the present embodiment, the depth of the grooves 107 is formed to be about the thickness of the dielectric layer 133 such that a part of the front substrate 3 is exposed.

Figure 10E:
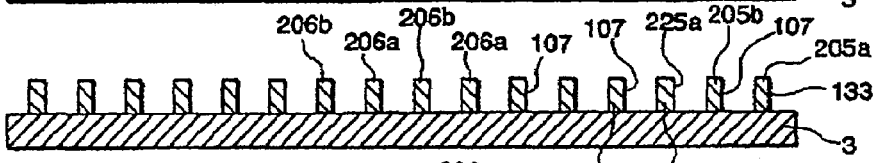

Subsequently, the part of the dielectric layer 133 exposed through the openings 136 is selectively etched using a sandblasting machine to form barrier rib members 205*a*, 205*b*, 206*a*, and 206*b* (FIG. 10E). In this case, the dielectric layer 133 is etched until the front substrate 3 is exposed. The barrier rib members 205*a*, 205*b*, 206*a*, and 206*b* define the discharge spaces 225*a* in the dielectric layer 133. In addition, grooves 107 are disposed between the barrier rib members 205*a* and 205*b* and between the barrier rib members 206*a* and 206*b*. The resist 134 for sandblasting is then peeled off using the resist stripper, and the dielectric layer 133 is cleaned with pure water and dried. The grooves 107 and the barrier rib members 205*a*, 205*b*, 206*a*, and 206*b* may be formed at the same time or successively.

Figure 10F:
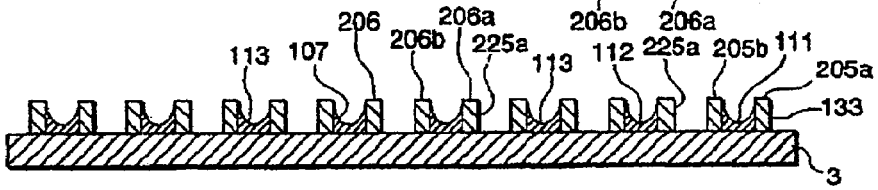

Next, the inner surface of the grooves 107 is coated such that display electrodes 111 and 112 having a cross-section in a U shape are formed thereon (FIG. 10F). Preferably, the display electrodes 111 and 112 are formed of the paste according to the first embodiment.

The aforementioned paste for display electrodes is filled into the grooves 107 using a screen printing method, a dispensing method, or an ink jet method. Thereafter, the paste for display electrodes is heated up and dried at approximately 150° C. for about 30 minutes using an electrical furnace or an oven with a constant temperature. Accordingly, the volume of the paste for display electrodes contracts, and the display electrodes 111 and 112 having a cross-section in a U shape are formed on the inner surface of the grooves 107 (FIG. 10F). The grooves 107 are not completely filled with the display electrodes 111 and 112 because the volume of the paste for display electrodes contracts, so grooves 113 are formed in the display electrodes 111 and 112.

Another paste having the dielectric substance of the dielectric layer 133 is then applied using a screen printing method or a dispensing method. Accordingly, another dielectric 8 layer 234 is formed on the grooves 113 of the display electrodes 111 and 112 and on the top surface of the barrier rib members 205*a*, 205*b*, 206*a*, and 206*b*. According to the present embodiment, the paste is filled into the grooves 113 using a screen method or a dispensing method until the paste completely covers the top surface of the barrier rib members 205*a*, 205*b*, 206*a*, and 206*b* (FIG. 10G), and the paste is not applied to the discharge spaces.

Figure 10G:
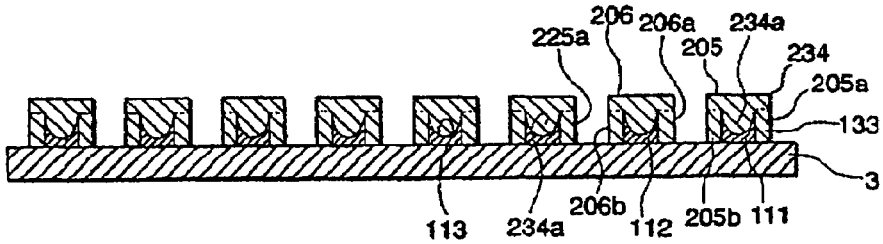

Thereafter, the paste is heated and dried at approximately 150° C. for about 30 minutes using an electrical furnace or an oven with a constant temperature, thereby forming another dielectric layer 234 (FIG. 10G). The dielectric layer 234 is filled into the grooves 113 while being laminated on the top surface of the barrier rib members 205*a*, 205*b*, 206*a*, and 206*b*. The dielectric layer 234 filled into the grooves 113 serves as a reinforcing material 234*a* of the display electrodes 111, 112. The dielectric layer 234 is formed of the dielectric paste used in forming the dielectric layer 133 such that the dielectric layer 133 is integrated with the dielectric layer 234. Accordingly, the dielectric layer 234 and the barrier rib members 205*a* and 205*b* are united each other, thereby forming the barrier rib members 205, and the dielectric layer 234 and the barrier rib members 206*a* and 206*b* are united each other, thereby forming the barrier rib members 206. The firing process is then performed in a temperature range where the barrier rib members 205 and 206, the display electrodes 111 and 112, and the reinforcing material 234*a* sinter, for example in a temperature range of approximately 550° C. to 600° C.

The display electrodes 111 and 112 are thereby buried in the barrier rib members 205 and 206, respectively, and a dielectric substance of the barrier rib members 205 and 206 is disposed between the discharge space 225*a* and the display electrodes 111 and 112

Figure 11A:
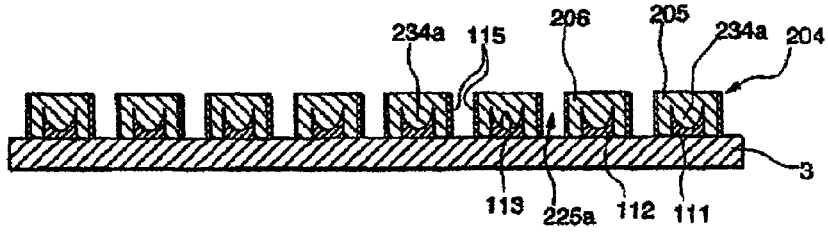
FIG. 11A through FIG. 11C are process views showing the manufacturing method of the plasma display panel according to the third embodiment of the present invention.

Then, a MgO layer with a 7000 Å thickness is deposited on the sidewall of the barrier rib members 205 and 206 using evaporation coating, thereby forming a transparent protective layer 115 (FIG. 11A). Therefore, the barrier rib layer 204 is formed on the front substrate 3.

Figure 11B:
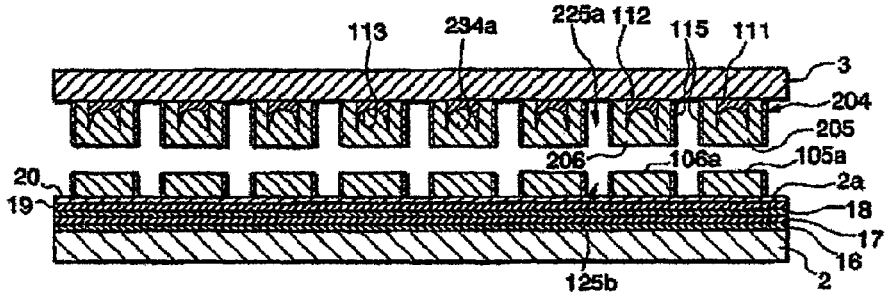
Figure 11C:
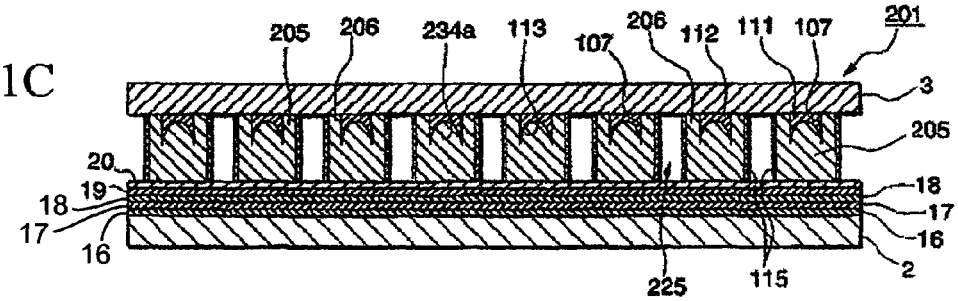

The undercoating layer 16 through the phosphor layer 20 and the lower barrier rib members 105*a* and 106*a* are successively formed on the inner surface 2*a* of the rear substrate 2. The front substrate 3 having the barrier rib layer 204 and the rear substrate 2 are then aligned and attached to each other such that the discharge spaces 225*a* formed on the front substrate 3 and the discharge spaces 125*b* formed on the rear substrate 2 are integrated (FIG. 11B). Thereafter, the periphery of the attached PDP 201 is sealed with a sealing material such as glass frit, and a discharge gas such as Xe gas is injected into the integrated discharge spaces 225, thereby completing the manufacture of the PDP 201 according to the present embodiment (FIG. 11C). Thus, the construction of the PDP according to the present embodiment is substantially the same as the construction of the second embodiment.

According to the manufacturing method of the PDP 201 of the present embodiment, the discharge spaces 225*a* and the grooves 107 where the display electrodes 111 and 112 are formed can be formed at the same time using one resist layer. Accordingly, the process of patterning the resist can be omitted, and the manufacturing process can be simplified. In addition, the manufacturing processes can be further simplified in the case that the grooves 107 and the discharge spaces 225*a* are formed at the same time.

According to the first to third embodiments, the phosphor layer 20 is formed on the inner surface 2*a* of the rear substrate 2. However, the phosphor layer 20 may be formed on the front substrate 3 facing the rear substrate 2. In addition, the pattern of the barrier ribs 19 formed on the inner surface of the rear substrate 2 is not limited to the matrix pattern with a lattice. In other words, the barrier ribs may be formed in a honeycomb pattern or a stripe pattern.

According to the PDP of the present invention, since the barrier rib layer includes the barrier rib members defining the discharge cells in a stripe or a matrix pattern, the grooves formed in a predetermined direction on the barrier rib members facing the front substrate, and the display electrodes coating the inner surface of the grooves to form the opposing electrodes, it is possible to control the ratio of area occupied by the display electrodes on the front substrate. In addition, the brightness can be enhanced.

In addition, according to the PDP of the present invention, since the reinforcing material made of a dielectric substance is formed in the grooves coated with the display electrodes, it is possible to increase the mechanical strength of the barrier rib layer and the product yield.

Further, according to the manufacturing method of the PDP of the present invention, the dielectric layer that is a base material of the barrier rib layer is formed on the support member, and the grooves in the stripe or the matrix pattern are formed on the dielectric layer. Then, the paste for display electrodes is applied to the inner surface of the grooves and dried, thereby forming display electrodes. As a result, the ratio of area occupied by the display electrodes can be controlled. In addition, the PDP having the above structure can be easily manufactured with a low cost.

Still further, according to the manufacturing method of the PDP of the present invention, since the dielectric layers are patterned after the display electrodes are formed, the manufacturing process of the barrier rib layer can be simplified. Alternatively, since the step of forming the grooves and the step of patterning the dielectric layer can be performed at the same time or successively, it is possible to simplify the manufacturing process of the PDP.

In addition, according to the manufacturing method of the PDP of the present invention, the paste for the reinforcing material having a dielectric substance is applied to the grooves of the display electrodes, and dried. As a result, a PDP in which the mechanical strength of the barrier rib layer and the product yield are increased can be easily manufactured with a low cost.

Lastly, according the manufacturing method of the PDP of the present invention, since the front substrate serves as the supporting member, it is possible to form the barrier rib layer on the front substrate. As a result, the manufacturing process of the PDP can be simplified.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel, comprising:

a front substrate and a rear substrate;

address electrodes extending in a predetermined direction on the rear substrate; and a barrier rib layer disposed between the front and rear substrates for defining a plurality of discharge spaces, wherein the barrier rib layer includes barrier rib members for defining the plurality of discharge spaces, and display electrodes forming opposing electrodes with the discharge spaces therebetween, and wherein grooves are formed in a direction crossing the address electrodes on the barrier rib members facing the front substrate, and inner surfaces of the grooves are coated with the display electrodes.

2. The plasma display panel of claim 1, further comprising a reinforcing material made of a dielectric substance filling grooves formed in the display electrodes.

3. The plasma display panel of claim 2, wherein the display electrodes are formed to correspond to a shape of the grooves by a volume contraction during firing, and wherein the reinforcing material is filled into the grooves formed in the display electrodes.

4. The plasma display panel of claim 1, further comprised of the grooves being formed in the surface of the barrier rib members facing the front substrate.

5. A manufacturing method of plasma display panel having a front substrate and a rear substrate facing each other, address electrodes extending in a direction between the front and rear substrates, and a barrier rib layer disposed between the front and rear substrates for defining a plurality of discharge spaces, the method comprising:

forming a dielectric layer on a support member, the dielectric layer being a base material of the barrier rib layer;

forming grooves in a direction crossing the address electrodes on the dielectric layer;

applying a paste for display electrodes into the grooves; and forming the display electrodes covering inner surfaces of the grooves by drying the paste for display electrodes.

6. The manufacturing method of claim 5, further comprised of forming barrier rib members for defining the plurality of discharge spaces by patterning the dielectric layer after forming the display electrodes.

7. The manufacturing method of claim 5, further comprising forming barrier rib members for defining the plurality of discharge spaces by patterning the dielectric layer after forming the grooves.

8. The manufacturing method of claim 5, further comprising forming barrier rib members for defining the plurality of discharge spaces by patterning the dielectric layer at the same time as forming the grooves.

9. The manufacturing method of claim 5, further comprising:

applying a paste for a reinforcing material into grooves of display electrodes, and forming the reinforcing material by drying the paste.

10. The manufacturing method of claim 5, wherein the supporting member is the front substrate.

11. The plasma display panel of claim 5, further comprised of the grooves being formed in the surface of the barrier rib members facing the front substrate, and the grooves being coated with the display electrodes.

12. The plasma display panel of claim 5, further comprised of:

the grooves being formed in the surface of the barrier rib members facing the front substrate, and the grooves being coated with the display electrodes; and a reinforcing material made of a dielectric substance, filling the grooves.

13. A method for manufacturing a plasma display panel and a plasma display panel manufactured by the method, having a front substrate and a rear substrate facing each other, address electrodes extending in a direction between the front and rear substrates, and a barrier rib layer disposed between the front and rear substrates for defining a plurality of discharge spaces, the method comprising:

forming a dielectric layer on a support member, the dielectric layer being a base material of the barrier rib layer;

forming grooves in a direction crossing the address electrodes on the dielectric layer;

applying a paste for display electrodes into the grooves; and forming the display electrodes covering inner surfaces of the grooves by drying the paste for display electrodes.

14. The method and plasma display panel of claim 13, further comprised of forming barrier rib members for defining the plurality of discharge spaces by patterning the dielectric layer after forming the display electrodes.

15. The method and plasma display panel of claim 13, further comprising forming barrier rib members for defining the plurality of discharge spaces by patterning the dielectric layer after forming the grooves.

16. The method and plasma display panel of claim 13, further comprising forming barrier rib members for defining the plurality of discharge spaces by patterning the dielectric layer at the same time as forming the grooves.

17. The method and plasma display panel of claim 13, further comprising:

applying a paste for a reinforcing material into grooves of display electrodes, and forming the reinforcing material by drying the paste.

18. The plasma display panel of claim 13, further comprised of the grooves being formed in the surface of the barrier rib members facing the front substrate, and the grooves being coated with the display electrodes.

19. The plasma display panel of claim 13, further comprised of:

the grooves being formed in the surface of the barrier rib members facing the front substrate, and the grooves being coated with the display electrodes; and a reinforcing material made of a dielectric substance, filling the grooves.

* * * * *